US006259416B1

(12) United States Patent
Qi et al.

(10) Patent No.: US 6,259,416 B1
(45) Date of Patent: Jul. 10, 2001

(54) WIDEBAND SLOT-LOOP ANTENNAS FOR WIRELESS COMMUNICATION SYSTEMS

(75) Inventors: Yihong Qi; Lizhong Zhu, both of Waterloo; Xifan Chen, Kitchener, all of (CA); Wutu Wang, Xian (CN)

(73) Assignee: Superpass Company Inc., Waterloo (CA)

( * ) Notice: Subject to any disclaimer, the term of this patent is extended or adjusted under 35 U.S.C. 154(b) by 0 days.

(21) Appl. No.: 09/305,321

(22) Filed: May 5, 1999

Related U.S. Application Data

(63) Continuation-in-part of application No. 09/035,697, filed on Mar. 5, 1998

(60) Provisional application No. 60/043,212, filed on Apr. 9, 1997.

(30) Foreign Application Priority Data

Feb. 26, 1999 (CA) ..... 2263055

(51) Int. Cl.[7] ..... H01Q 13/10; H01Q 21/00

(52) U.S. Cl. ..... 343/767; 343/725; 343/866

(58) Field of Search ..... 343/767, 768, 343/769, 770, 700 MS, 725, 866, 741

(56) References Cited

U.S. PATENT DOCUMENTS

| | | | |
|---|---|---|---|
| 2,507,528 | 5/1950 | Kandoian | 343/767 |
| 2,820,220 | 1/1958 | Charman | 343/749 |
| 3,031,665 | 4/1962 | Marie | 343/767 |
| 3,971,032 | 7/1976 | Munson et al. | 343/767 |
| 4,060,810 | 11/1977 | Kerr et al. | 343/700 MS |
| 4,138,684 | 2/1979 | Kerr | 343/846 |
| 4,291,312 | 9/1981 | Kaloi | 343/700 MS |
| 4,443,805 | 4/1984 | Havot | 343/803 |
| 4,498,085 | 2/1985 | Schwarzmann | 343/795 |
| 4,613,868 | 9/1986 | Weiss | 343/700 MS |
| 4,692,769 | 9/1987 | Gegan | 343/700 MS |
| 4,766,440 | 8/1988 | Gegan | 343/700 MS |
| 4,843,403 * | 6/1989 | Lalezari et al. | 343/767 |
| 5,198,826 | 3/1993 | Ito | 343/726 |
| 5,371,507 | 12/1994 | Kuroda et al. | 343/700 MS |
| 5,400,041 | 3/1995 | Strickland | 343/700 MS |
| 5,404,146 | 4/1995 | Rutledge | 343/720 |
| 5,432,518 | 7/1995 | van Erven | 343/742 |
| 5,512,910 | 4/1996 | Murakami et al. | 343/700 MS |
| 5,526,003 | 6/1996 | Ogawa et al. | 343/700 MS |
| 5,627,550 | 5/1997 | Sanad | 343/700 MS |
| 5,657,028 | 8/1997 | Sanad | 343/700 MS |
| 5,691,731 | 11/1997 | van Erven | 343/742 |

OTHER PUBLICATIONS

M. Cai and M. Ito: "New Type of Printed Polygonal Loop Antenna", IEE Proceedings—H, vol. 138, No. 5, Oct. 1991, pp. 389–396.

* cited by examiner

*Primary Examiner*—Don Wong
*Assistant Examiner*—Toang Nguyen
(74) *Attorney, Agent, or Firm*—Kevin Pillay; Faskin Martineau DuMoulin LLP

(57) ABSTRACT

A wideband slot-loop antenna is described which comprises a generally planar loop element having a generally rectangular outer perimeter and a slot defining an inner perimeter, the mid portion of the slot-loop structure providing a major radiation portion of the antenna; a loading structure extending from one end of the slot, the loading structure for top loading the radiation portion; and an impedance matching portion for coupling a feed to the major radiation portion. The antenna also includes distributed matching patches. The distributed matching patches realize extra wideband performance. The antennas in the present invention are suitable for various wireless communications, such as PCS, Cellular Telephone, wireless data and computer network.

14 Claims, 11 Drawing Sheets

Figure 6a Radiation Pattern (H-Plane)
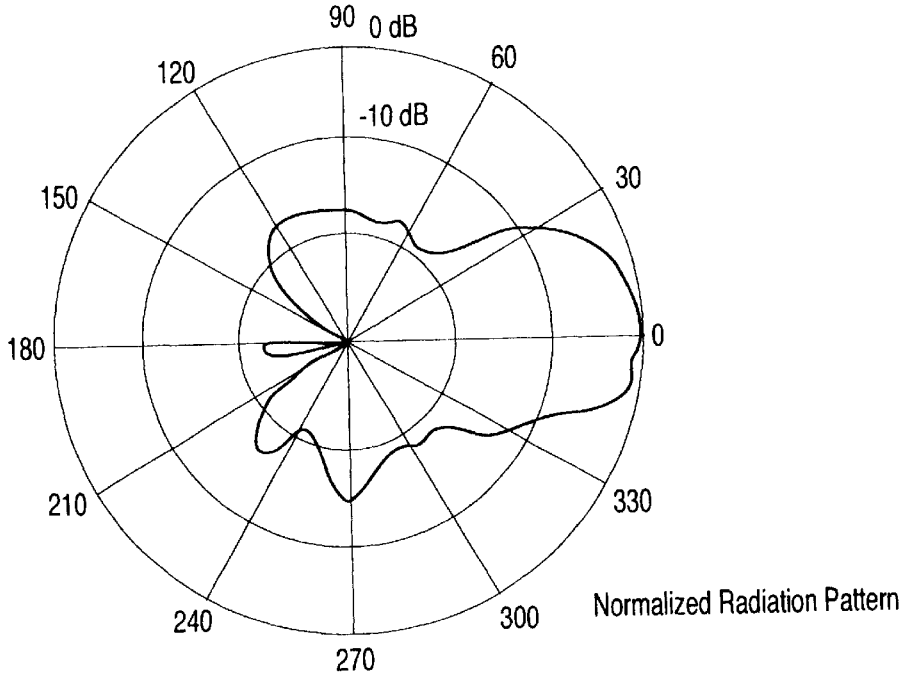
Figure 6b Radiation Pattern (E-Plane)
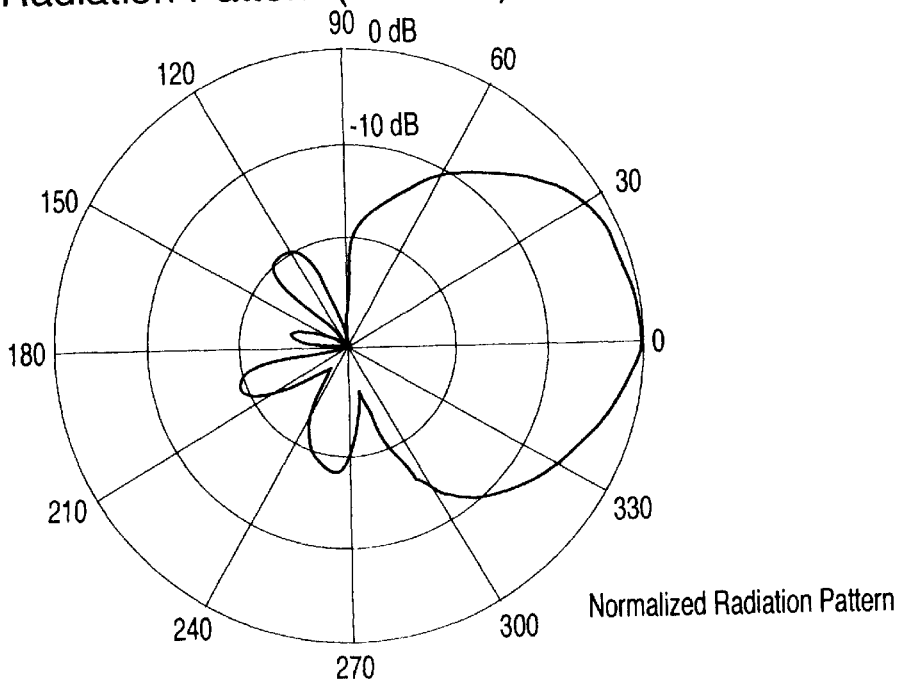

WIDEBAND SLOT-LOOP ANTENNAS FOR WIRELESS COMMUNICATION SYSTEMS

This application is a continuation-in-part of U.S. Pat. No. 09/035,697 filed Mar. 5, 1998 and also claims benefit of Provisional No. 60/043,212 filed Apr. 9, 1997.

The present invention relates to wideband slot antennas, and more particularly, to slotted loop antennas.

BACKGROUND OF THE INVENTION

Antennas are used for various communication systems, such as television (TV), cellular phone, wireless data and local area network (LAN), personal communication service (PCS), etc., which are the rapidly developing areas. A clear and strong signal and wide coverage of sending and receiving information are very critical for the wireless communication systems. Therefore, good antennas are required.

Existing antennas in the market are proven to have various problems, such as narrow bandwidth, low gain, larger size and high cost. The narrow bandwidth particularly limits the range of applications. For example, if an antenna designed for person communication network (PCN) frequency band may not cover PCS frequency band. The low gain results in poor coverage in communication systems; vice-versa requiring high receiving sensitivity, or high transmission power. Most users prefer smaller size antenna to create open space. Lastly, the high cost is due to the complexity of structures of antennas available today.

Back to the early 1990's, a reflector-backed slot-loop antenna was proposed by M. Cai and M. Ito in an article "New Type of Printed Polygonal Loop Antenna; IEE Proceedings-H, Vol. 138, No. 5, Oct. 1991, pp 389–396". The antenna was designed based on the idea of combining a simple polygonal loop antenna and a rectangular slot antenna. Therefore, the antenna as proposed possesses the advantages of polygonal loop and rectangular slot antennas, such as high directivity as well as high tolerance in production. In addition, this antenna is described as having a 24% impedance bandwidth. However, because a rectangular slot is used as a main radiation portion, the radiation is not very efficient. This antenna is not suitable for wider bandwidth applications (such as television) due to its limited bandwidth. Moreover, this type of antenna is limited in the various radiation patterns it provides. In addition, the back feed introduces problems in the manufacturing process.

In view of the various drawbacks associated with current antennas, it would be advantageous to provide an antenna, which mitigates some of these problems to provide a more reliable and efficient antenna design. Therefore, there is a need for an antenna with some of the following characteristics: high gain in order to improve the performance of the existing communication systems such as sensitivity and effective radiation power; increased bandwidth for wider frequency coverage and multiple system applications; configurable for multiple radiation patterns to accommodate different environmental scenarios; a simplified layout for easy manufacture at a high yield and at low cost; and easy installation.

SUMMARY OF THE INVENTION

In the present invention, novel top loaded antenna structures are applied to provide higher radiation efficiency and wide bandwidth potential. In conjunction with the top loaded structure, matching circuits are investigated to give extra wideband performance. The antennas thus invented also provide both uni-directional and bi-directional radiation patterns. To overcome the inefficiency of feeding an RF signal to an antenna, simple feed structures are used to make the antenna easily manufactured, cost effective, and suitable to different kinds of applications.

Antennas according to an embodiment of the present invention, preferably include unique simple antenna structures with top loaded shapes and distributed matching circuits to provide wide bandwidth potential, high gain, smaller size and desired radiation pattern.

BRIEF DESCRIPTION OF THE DRAWINGS

These and other features of the preferred embodiments of the invention will become more apparent in the following detailed description in which reference is made to the appended drawings wherein:

FIGS. 3(*a*) and 3(*b*) show respective E-plane and H-plane radiation patterns;

FIGS. 6(*a*) and 6(*b*) show respective E-plane and H-plane uni-directional radiation patterns of the antenna shown in FIG. 5;

DETAILED DESCRIPTION OF A PREFERRED EMBODIMENT

Figure 1:
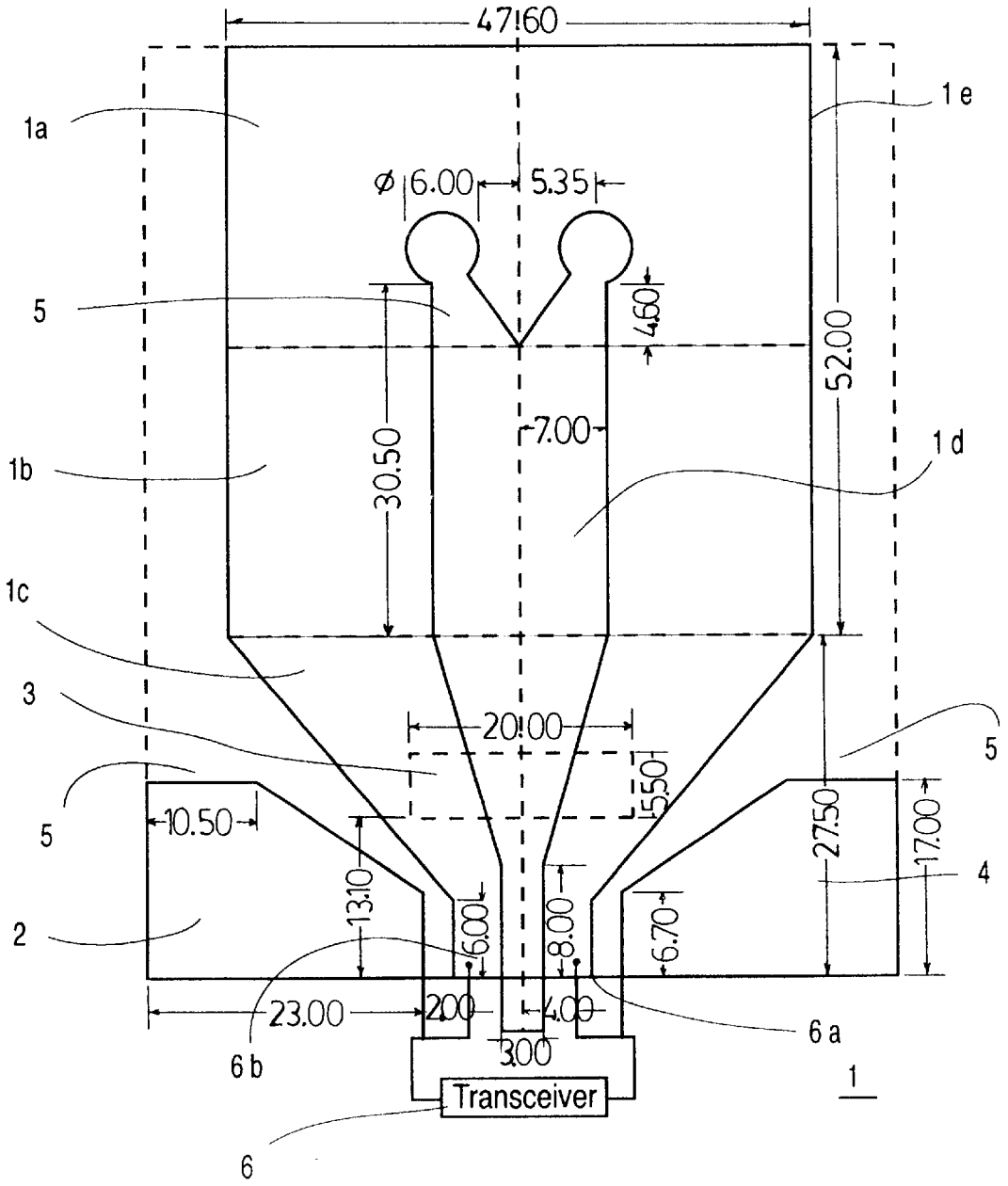
FIG. 1 is a top view of a planar antenna configuration and the associated matching circuits according to an embodiment of the present invention.

Referring to FIG. 1, a general geometry of an end driven antenna and its matching circuits, according to an embodiment of the present invention, is indicated generally by numeral 1. In this diagram all dimensions are indicated in millimeters. The antenna comprises a planar loop element having a generally rectangular outer perimeter 1(*e*) and a slot 1(*d*) defining an inner perimeter, the mid portion 1(*b*) of the slot-loop structure providing a major radiation portion of the antenna; a loading structure 1(*a*) having a double ring configuration extending from one end of the slot 1(*d*), the loading structure for top loading the radiation portion; and an impedance matching portion 1(*c*) for coupling a feed 6 to the major radiation portion 1(*b*). The antenna is preferably etched on a copper clad planar dielectric member, such as an FR4 printed circuit board (5). The FR4 material is only for supporting the antenna. The antenna may be coupled to a coaxial connector at the feed end of the antenna.

The double ring top loaded configuration (1*a*), provides an inductive top load that shrinks the overall antenna size, provides wideband potential, and improves radiation efficiency. The double rings have a diameter of approximately 3mm to 15 mm, but are not limited to this size as shown in FIG. 1. The middle part (1*b*), which is the major radiation portion, comprises a central slot structure with its longitudinal axis aligned along the longitudinal axis of the antenna such that an electromagnetic field is developed between the slot and the E-field normal to the metal edge and separates the radiation portion into the arms of the loop. The impedance transformation section 1(*c*) is comprised of a pair of tapered elements each coupling a feed 6(*a*) and 6(*b*) to a respective arm of the loop element. The impedance transformation section also behaves like a radiation portion. Note that sections (1*a*), (1*b*), and (1*c*) are distinguished from each other by dashed lines as shown in FIG. 1.

First and second patch elements (2) and (4) are formed proximate the respective outer edges of the impedance transformation element. The patch elements (2) and (4) are closely coupled to the impedance transformation portion (1*c*) and are employed as distributed matching components. They provide wide bandwidth performance in conjunction with the top-loaded structure. The patches (2) and (4) are formed on the same side of the printed board as the matching components. Either patch (2) or (4) can be, but are not limited to the shape and size as shown in FIG. 1, as long as a proper matching is achieved through the coupling effect.

A third patch element (3) is used to provide a capacitive coupling between both portions of the part (1*c*), which cancels the inductive part of the impedance looking into the part (1*c*) towards the radiation portion over a wide frequency range. Therefore, even wider bandwidth is achieved. This patch, being considered as a distributed matching component as well, it can be, but is not limited to the other side of the printed circuit board. Also, it can be, but not limited to the shape, size, and position as shown in FIG. 1. In use an RF signal from a transceiver or the like is coupled to the respective feed points thereby inducing a current in the antenna, alternatively a current induced in the antenna from a received signal is supplied to the transceiver (6).

Figure 2:
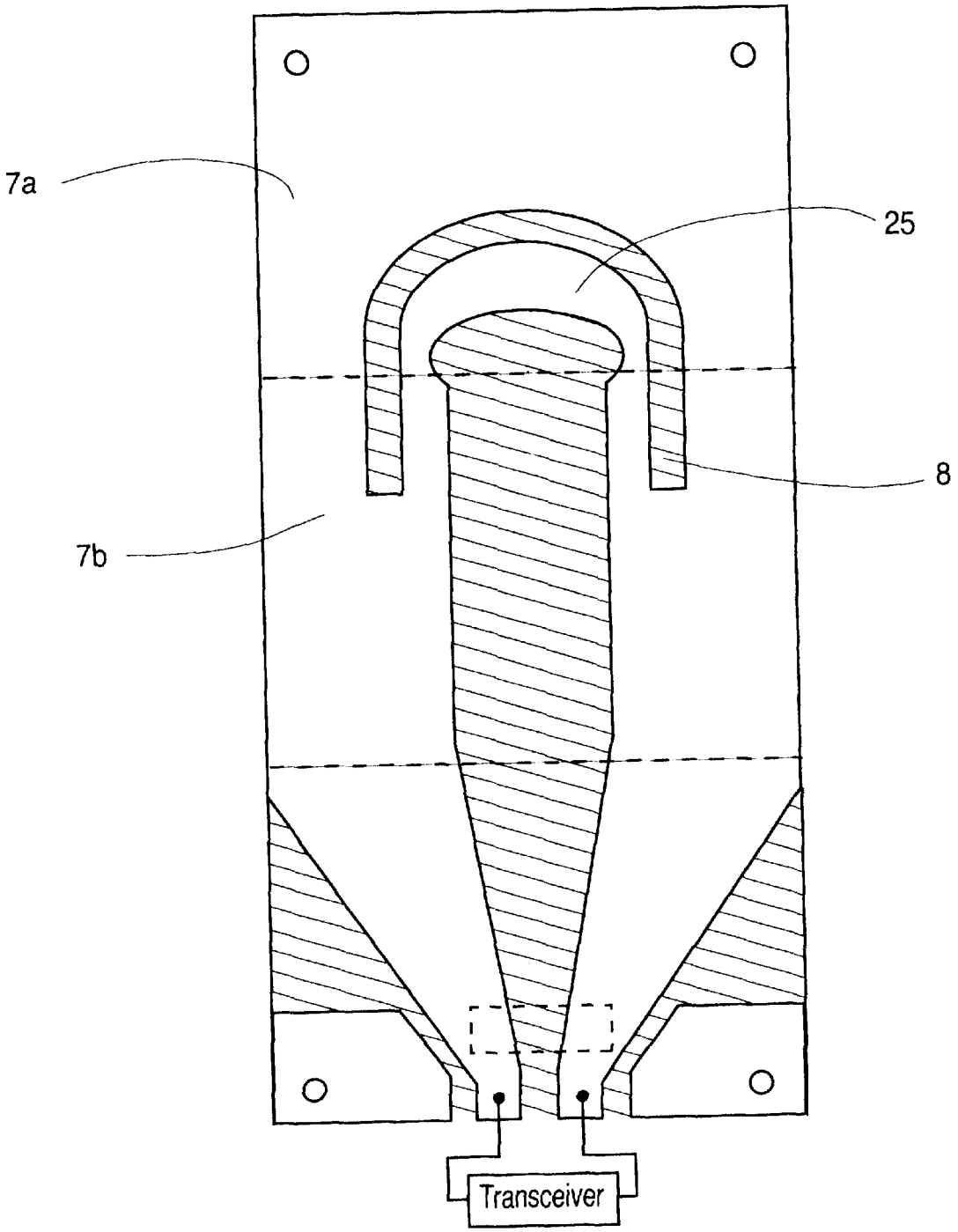
FIG. 2 is a top view of an antenna configuration with top-loaded U-shaped slot and matching circuits according to a further embodiment of the present invention.

Referring to FIG. 2 a further embodiment of a top loaded structure is shown. The top loading structure in this embodiment comprises a U-shaped narrow slot, the arms of the U extending into the respective dipoles sections 7(*b*) and the base of the U extending across the end of the slot in the section 7(*a*). The narrow slot has a length of approximately half a wavelength at the center frequency of antenna. The U-shaped narrow slot provides an inductive top loading for the antenna. Thus, the antenna size is reduced but its radiation efficiency is increased. In addition, the antenna with such top loaded configuration has a wide bandwidth potential. The other parts are the same as those in FIG. 1. The top loading structure may be a single ring as indicated by numeral (25) in FIG. 2 or a double ring configuration as indicated in FIG. 1.

Figure 3:
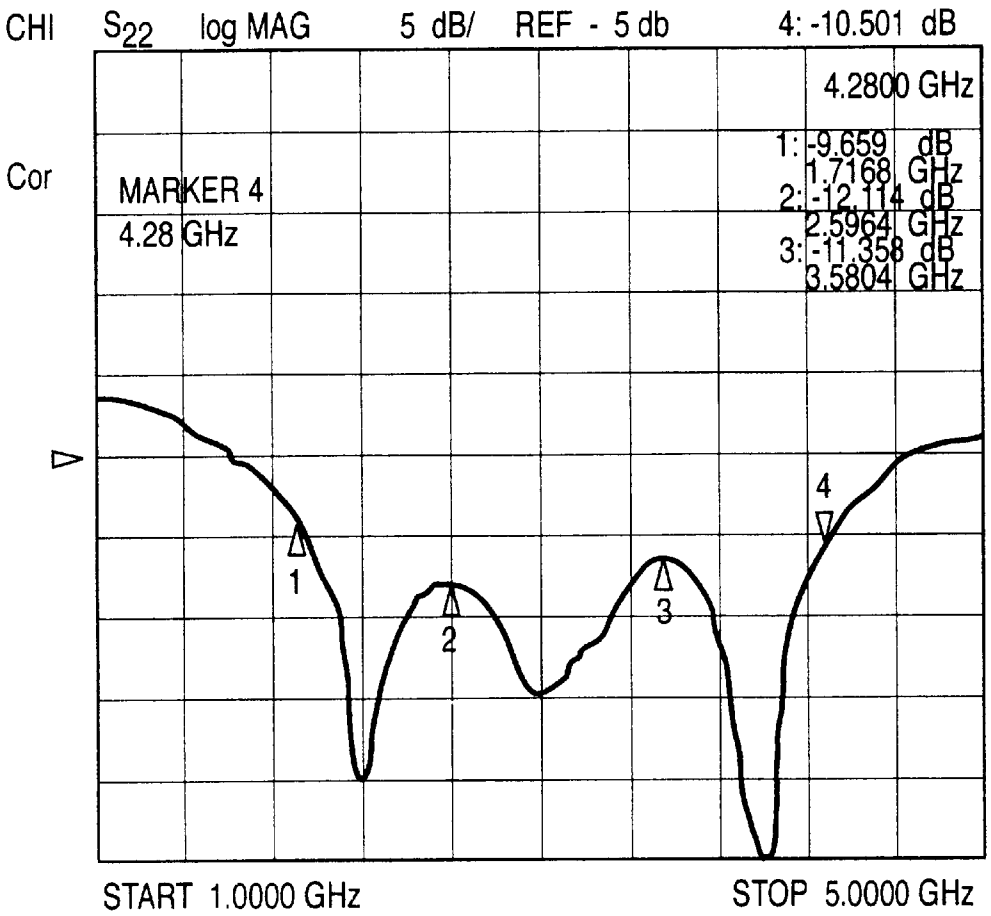
FIG. 3 is a graph showing the frequency response of the antenna shown in FIG. 1.

FIG. 3 shows the frequency response of the antenna configuration described with respect to FIG. 1, with approximately 85% of the bandwidth covering 1.7 GHz to 4.3 GHz.

Figure 4A:
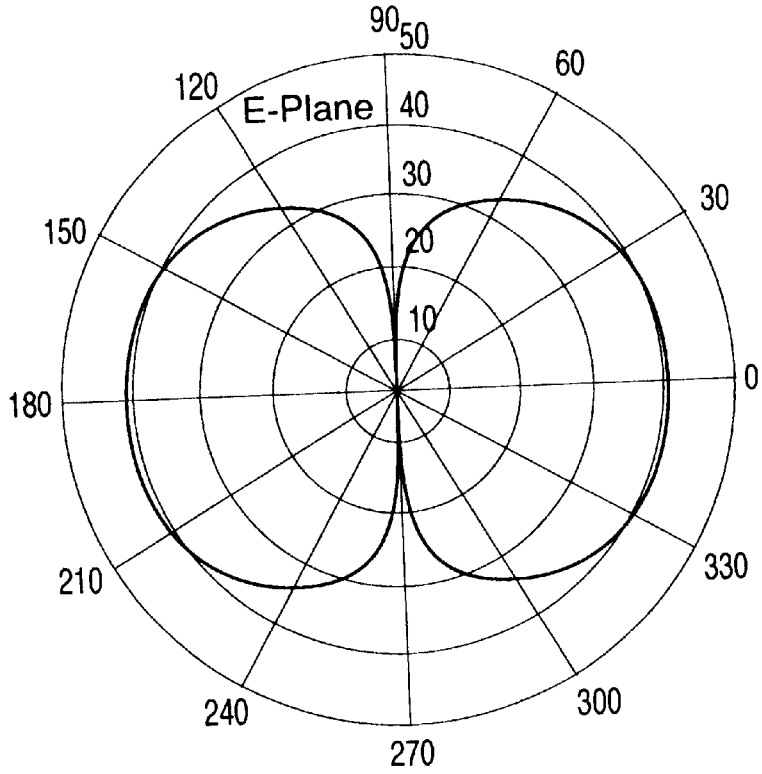
FIG. 4 bi-directional radiation patterns of the antenna shown in FIG. 1.
Figure 4B:
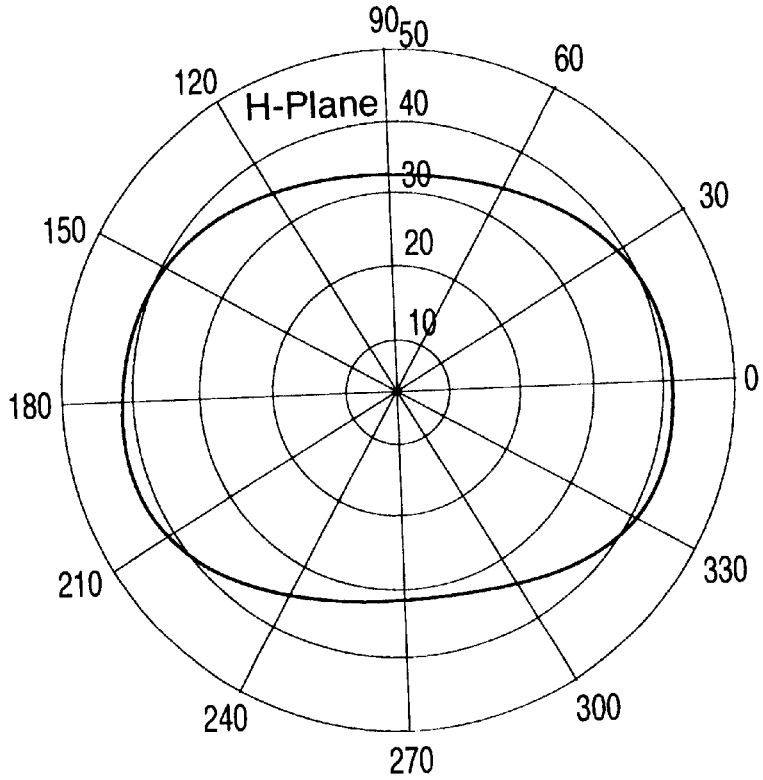

FIG. 4(*a*) shows the radiation pattern of the bi-directional antenna as described in FIG. 1 with a 70° beam width in both a forward and rear direction. FIG. 4(*b*) shows the corresponding H-plane radiation pattern. These patterns are very suitable for PCS systems, on street scenarios or corridor applications.

Figure 5:
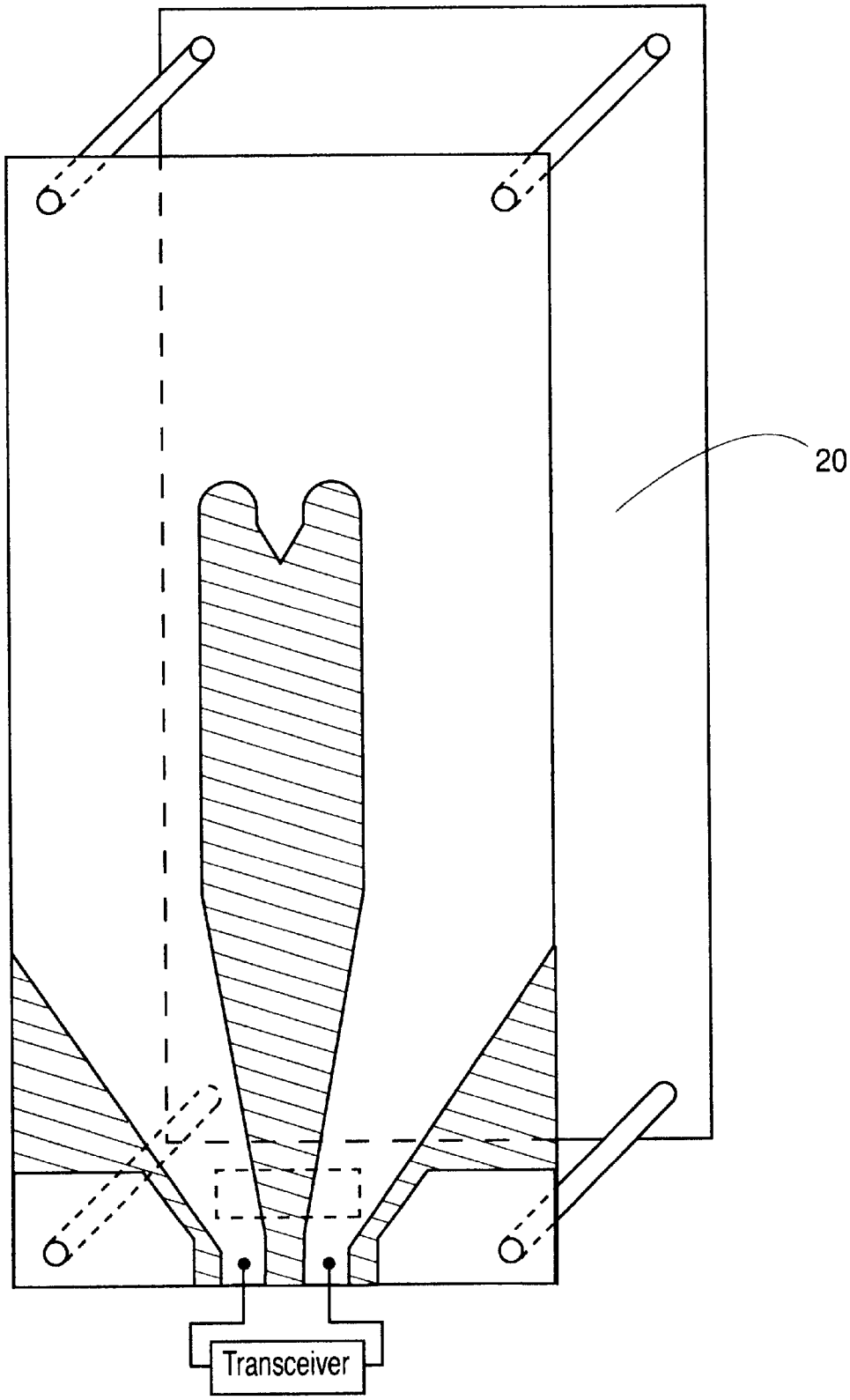
FIG. 5 is a schematic diagram of an antenna having a sheet metal reflector, according to an embodiment of the invention.

As shown in FIG. 5, an end driven antenna according to a further embodiment of the invention includes a ground plane (20) spaced from the radiation portion of the antenna described in FIG. 1. The ground plane causes the antenna to have a unidirectional radiation pattern as shown in FIGS. 6(*a*) and 6(*b*). It may be noted that the rigid dielectric shown in FIG. 1 may be replaced by for example air if the copper sections are sufficiently rigid.

Figure 7:
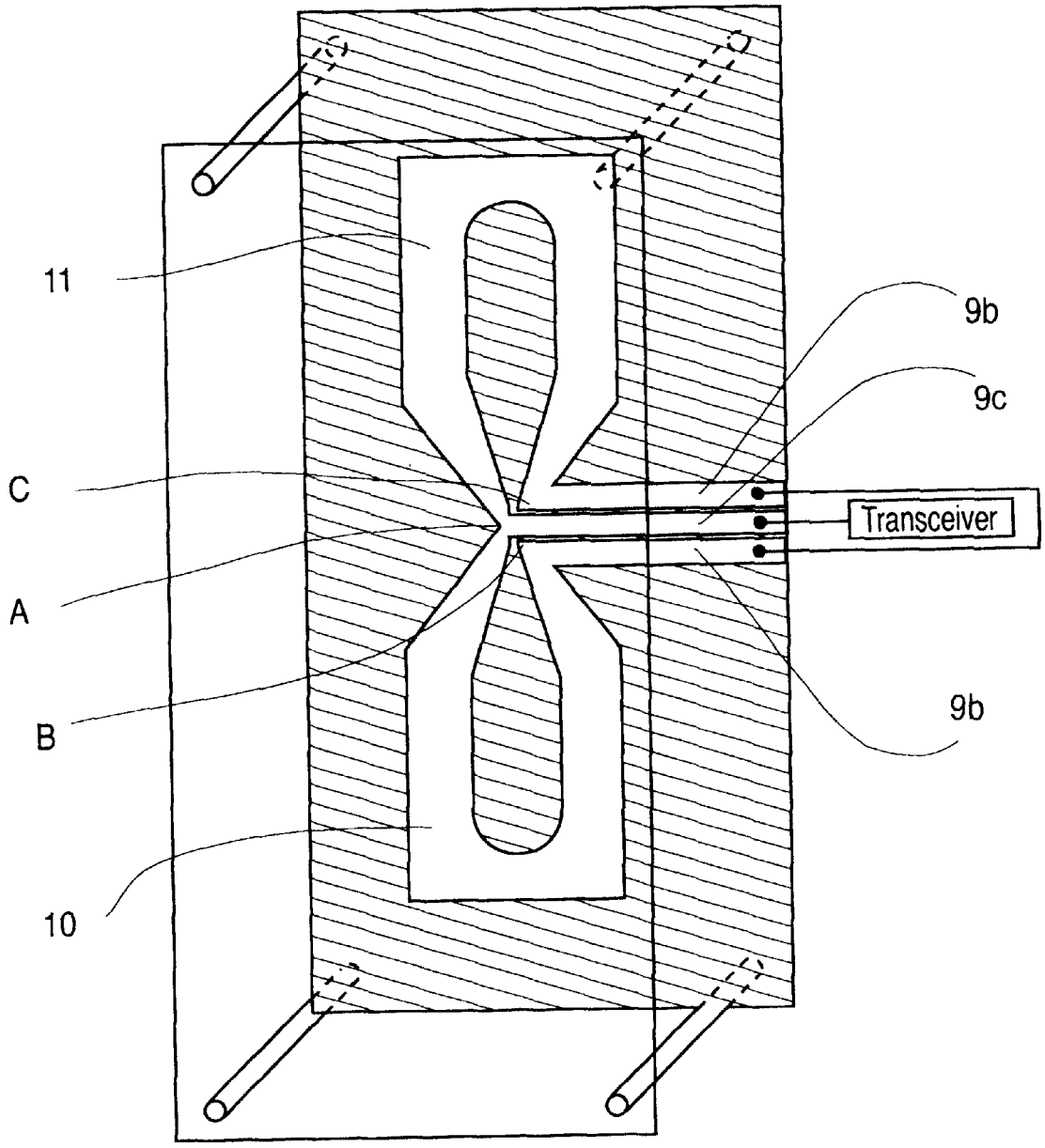
FIG. 7 is a schematic diagram of a 2-element antenna array configuration coplanar line feed structure according to an embodiment of the present invention.

FIG. 7 shows a balanced 2-element antenna array structure which is comprised of two end driven antennas connected at their driving points to form a center fed antenna. The driving point of the array is fed by coplanar transmission lines comprising a pair of outer transmission lines 9(*b*) and an inner transmission line 9(*a*), both extending from an edge of the substrate to the driving point. The inner conductor 9(*a*) is connected to a common feed point (A) of the radiation elements (10) and (11) which are electrically connected in parallel to form a balanced array. The outer conductors 9(*b*) are connected to respective center feed points (B) and (C) of the radiation elements (10) and (11). In this configuration, a ground plane is also used to direct the radiation. The radiation portion can be any configuration but is not limited to the ones described in FIG. 1 or FIG. 2.

Figure 8:
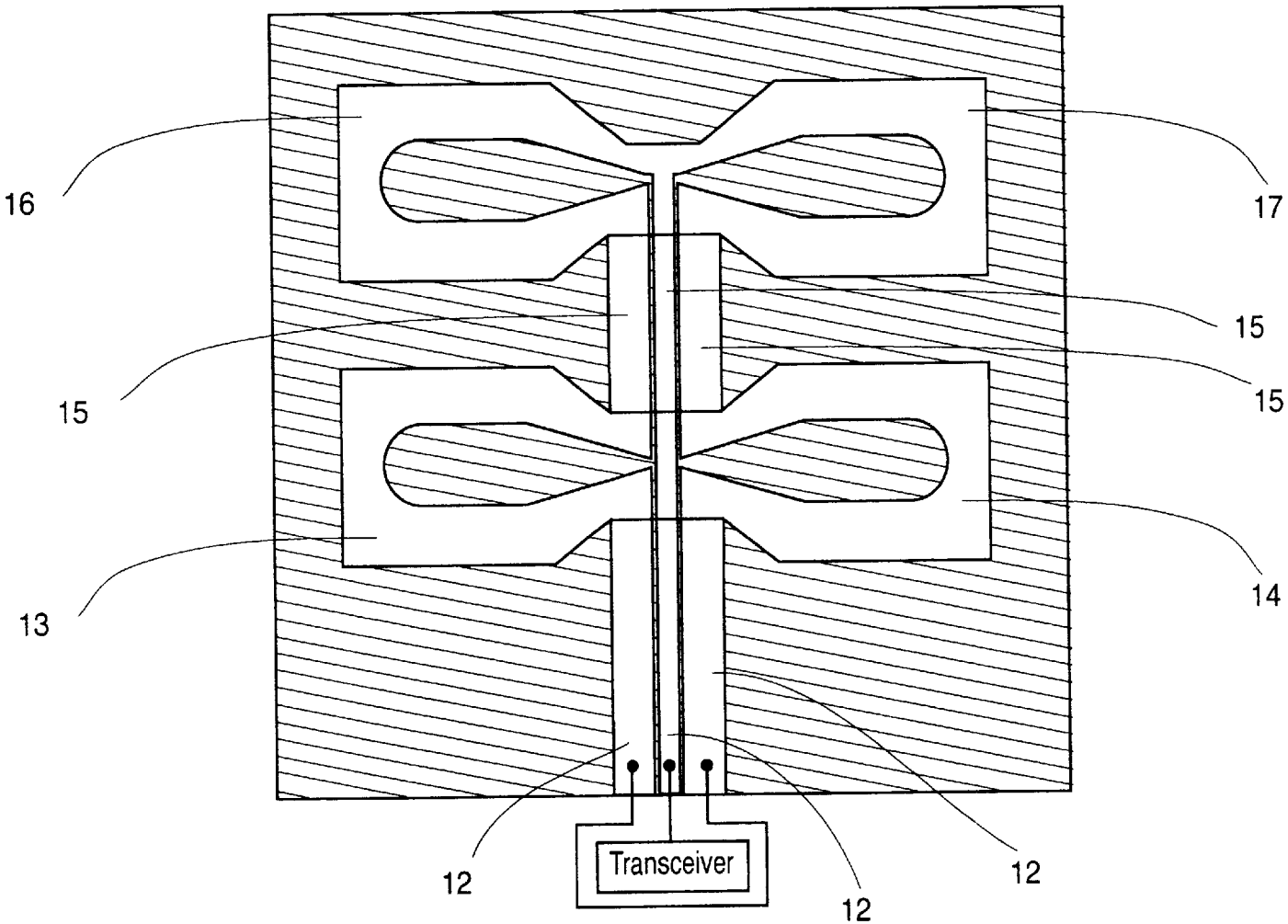
FIG. 8 is a schematic diagram of a 4-element antenna array configuration having a series feed structure according to the present invention.

FIG. 8 shows a 4-element antenna array having a balanced structure according to an embodiment of the invention. In this configuration, the antenna is also end-fed, however the RF signal is applied along a coplanar transmission line (12) to the radiators. Radiators (13) and (14) are electrically connected in parallel to form a balanced sub-array. Then, this sub-array is cascaded with about 0.65 wavelength coplanar transmission line (15). The other sub-array consisting of radiators (16) and (17) is terminated at the other end of the coplanar line (15). The radiation elements (13), (14), (16), and (17) can be any configuration, but are not limited to the ones described in FIG. 1 or FIG. 2.

Figure 9:
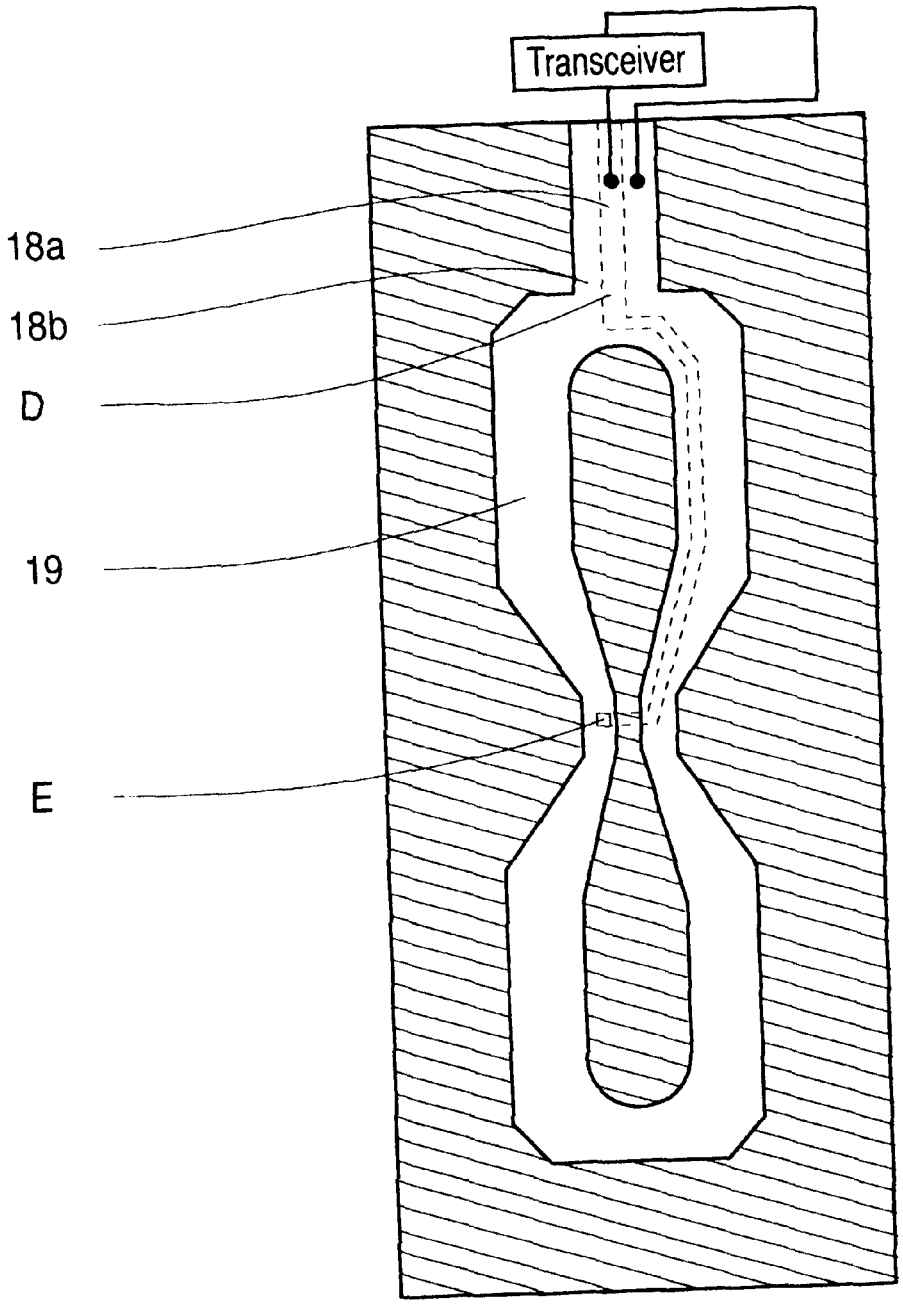
FIG. 9 is a schematic diagram of a 2-element antenna array configuration having a side feed structure according to an embodiment of the present invention.

FIG. 9 shows a 2-element antenna array with a side feed configuration according to another embodiment of the invention. The RF signal is fed along a microstrip transmission line (18), with the ground of the microstrip line (18*b*) connected to the center of the top load edge (D). The microstrip line is formed by the conductor part (18*a*) and part of the radiation element (19). The transmission line is terminated at the point (E) through a via. The radiation element (19) can be any slot-loop configuration, but is not limited to the ones described in FIG. 1 and FIG. 2.

Figure 10:
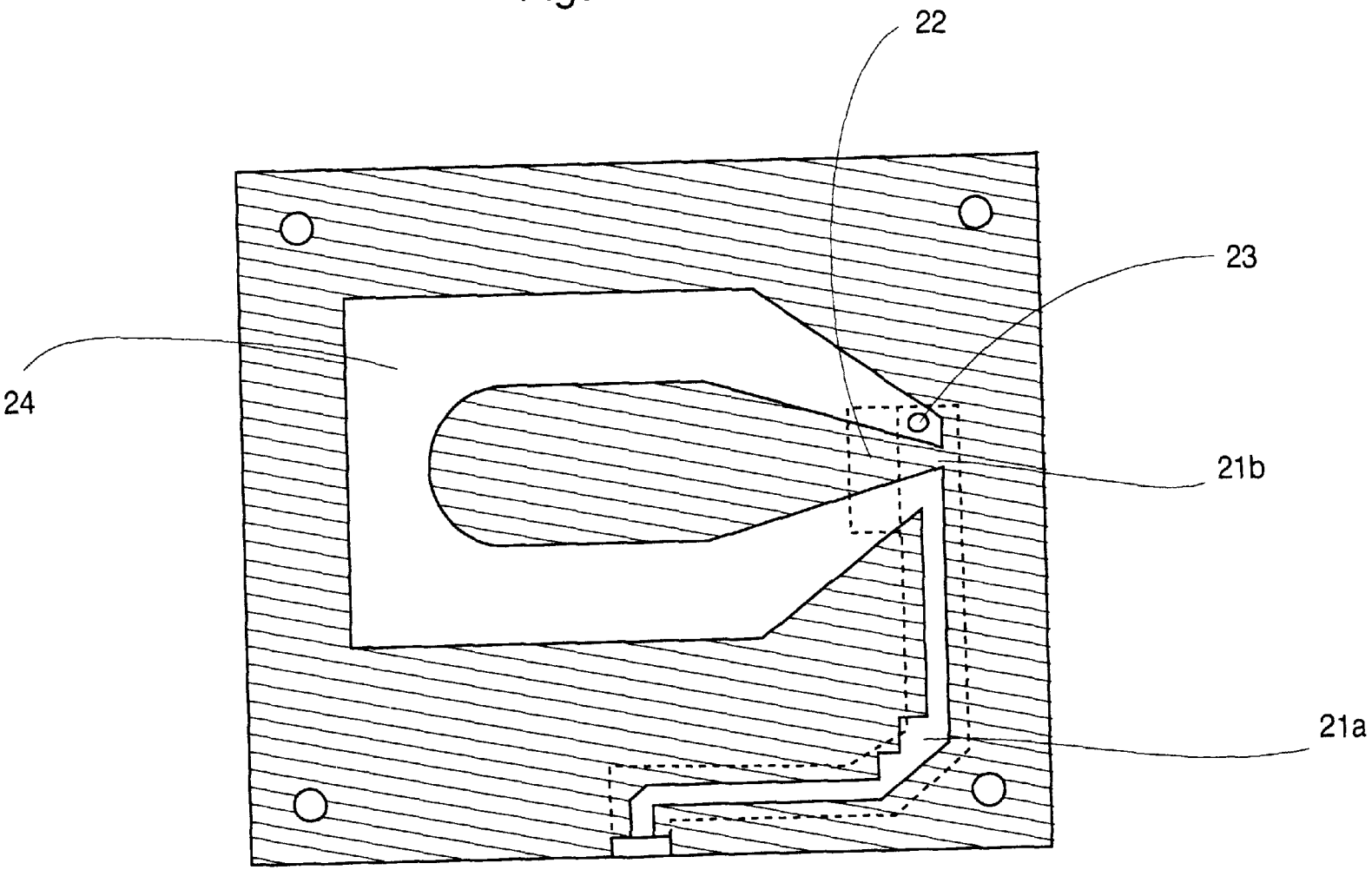
FIG. 10 is a schematic diagram of a single element antenna configuration having a bottom side feed microstrip line structure according to an embodiment of the present invention.

FIG. 10 shows a single element antenna with a bottom side-feed configuration according to a further embodiment of the invention. The feed structure (21*a*) and (21*b*) act as a low loss-matching network to provide wide bandwidth performance. A patch (22) distinguished from (21*b*) by a dashed line is used as a distributed matching component. It provides a capacitive coupling and cancels the inductive part of the impedance looking into the radiation portion. Note that this patch is different from the patch (3) as shown in FIG. 1, since it is not an isolated patch. The RF signal is fed through the matching network (21) and through a via (23) to a radiation element (24), which can be any configuration, but is not limited to the ones described in FIG. 1 and FIG. 2.

Figure 11:
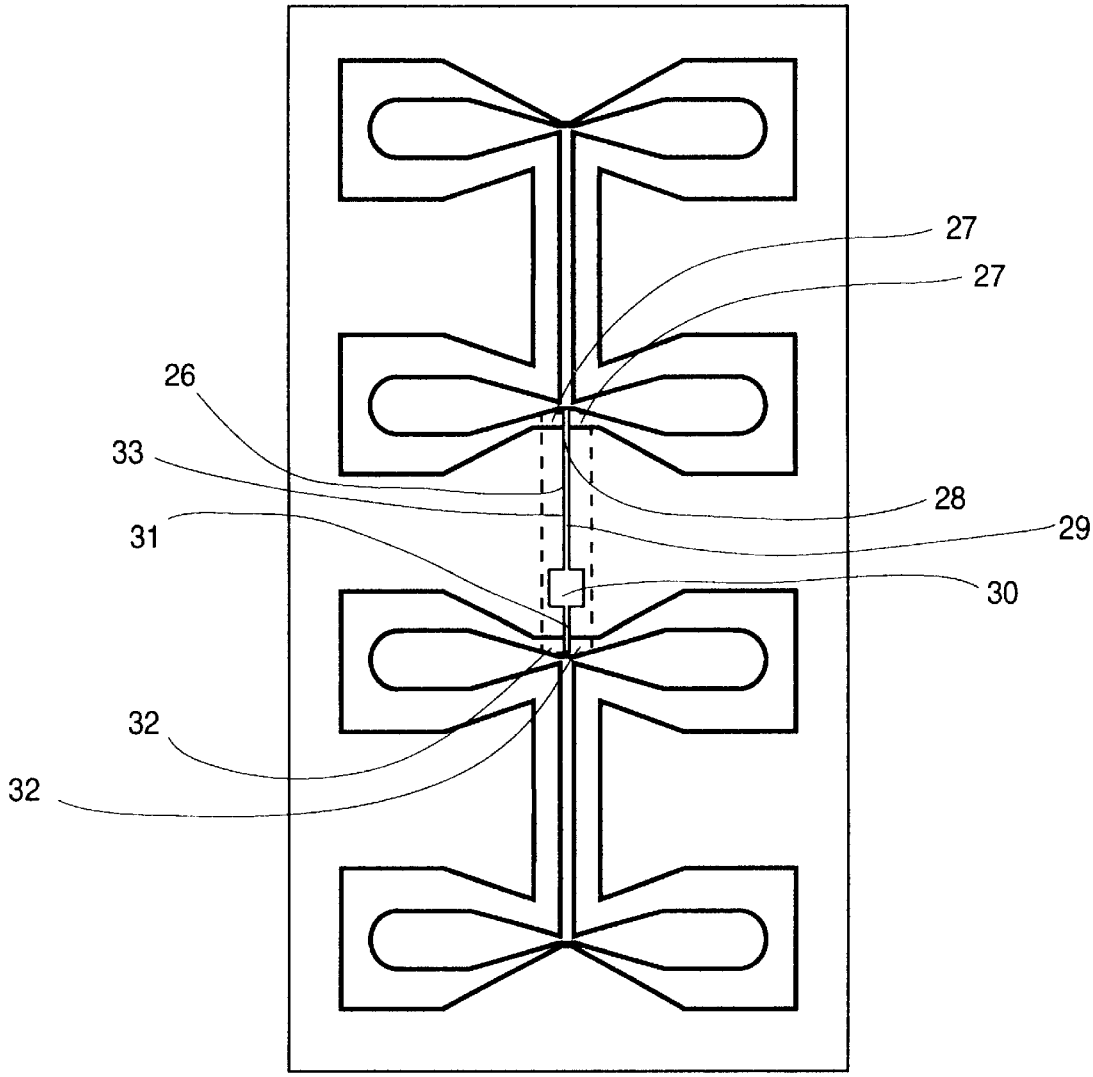
FIG. 11 is a schematic diagram of an 8-element antenna array configuration using the 4-element antenna array shown in FIG. 8.

FIG. 11 shows an 8-element antenna array with back-feed configuration, according to a still further embodiment of the invention. In this, embodiment two 4-elemet arrays as described in FIG. 8 are combined. For convenience, the arrays shall be referred to as top and bottom arrays, with both arrays formed on one of the surfaces of a dielectric member, referred to as the top layer. The arrays are connected by a micro-strip line extending between the feed points of the two arrays. The top and bottom copper layer of the dielectric member constitute the microstrip line. To properly feed the top 4-element antenna array and the bottom 4-element antenna array, transitions from coplanar transmission lines to microstrip lines are made by vias (27) and (32). The microstrip lines are constituted by a narrow copper strip (33) connecting the two arrays on the top layer and a wide copper strip (26) on the bottom layer (indicated by dashed lines) of the 60 mils FR-4 dielectric material. The narrow copper strip on the upper surface is comprised of three parts indicated by numerals 28, 29 and 31. Each of these part has a different width, thus each constituting a different microstrip line impedance. A small patch 30 is arranged at approximately a little more than a half a wavelength from the top array, to which a feed is applied.

The first microstrip (28)/(26) is a 70.7-Ohm quarter wavelength line that transforms the 50-Ohm impedance looking into the top 4-element antenna array to 100 Ohm. This 100 Ohm impedance is transformed further to the same impedance (i.e., 100 Ohm) by the middle microstrip (29)/(26), which is half wavelength long and provides 180 degrees phase shift. This 100 Ohm is then shunted with another 100 Ohm impedance transformed by the bottom microstrip (31)/(26) from the 50 Ohm impedance looking into the bottom 4-element antenna array to provide a 50 Ohm at the center of the small patch 30).

The patch (30) is also used to provide slight impedance tuning. A short cable is used to feed and/or pick-up an RF signal to and/or from the 8-element antenna array, respectively by connecting its center conductor to the top copper patch (30) via a hole and its outer shielding conductor to the bottom copper strip (26).

Thus, it may be seen that this invention provides a significant improvement of the prior art for the following reasons.

The double ring top loaded structure (1*a*), as shown in FIG. 1, provides wide bandwidth potential, smaller size, and highly efficient radiation capability.

The half wavelength U-shaped top-loaded structure, as shown in FIG. 2, provides wide bandwidth potential, smaller size, and highly efficient radiation capability.

Matching patches (2), (3), and (4) as shown in FIG. 1 and FIG. 2 are employed to provide extra wideband performance.

The simple and novel feed structure (9), by making use of a coplanar transmission line and electrically parallel connected radiation components as shown in FIG. 7, is used to minimize the insertion loss of the RF signal due to the feed structure, simplify the manufacturing, and provide flexibility in various applications.

A series feed structure with coplanar transmission lines (12) and (15) as shown in FIG. 8 is applied to the antenna array to achieve less insertion loss of the RF signal, simplify the manufacturing, and provide flexibility in various applications.

A side feed structure (18), by making use of a microstrip line and the radiation component as shown in FIG. 9, is employed to provide flexibility of feeding the RF signal to the radiation elements for the applications of large antenna array.

The matching patch (22), as shown in FIG. 10, in conjunction with a feed structure (21) (being also considered as the matching network) provides wide bandwidth performance and less insertion loss. The bottom side-feed configuration makes the antenna easily manufactured and the RF signal very conveniently fed into the antenna from the bottom.

The top and bottom microstrip (28)/(26) and (31)/(26) as shown in FIG. 11, respectively are quarter wavelength impedance transformers to transform the 50 Ohm impedances (looking into the top and bottom 4-element antenna arrays) to 100 Ohm. The middle microstrip (29)/(26) provides 180 degrees phase shift. The patch (30) is used to provide slight impedance tuning. A short cable is used to feed and/or pick-up an RF signal to and/or from the 8-element antenna array, respectively by connecting its center conductor to the top copper patch (30) via a hole and its outer shielding conductor to the bottom copper strip (26).

Although the invention has been described with reference to certain specific embodiments, various modifications thereof will be apparent to those skilled in the art without departing from the spirit and scope of the invention as outlined in the claims appended hereto.

We claim:

1. An antenna comprising:

(a) slot-loop structure having a generally planar loop element having a generally rectangular outer perimeter and a slot defining an inner perimeter of said structure, a mid portion of the slot-loop structure providing a major radiation portion of the antenna;

(b) a loading structure extending from one end of the slot, for top loading the radiation portion; and (c) an impedance matching portion for coupling a feed to the major radiation portion.

2. An antenna as defined in claim 1, said loading structure being a double ring configuration.

3. An antenna as defined in claim 1, said loading structure including a single ring configuration coupled to a U-shape narrow slot.

4. An antenna as defined in claim 3, said narrow slot being a half wavelength slot.

5. An antenna as defined in claim 1, said impedance matching portion comprising first and second tapered sections for connecting said feed to respecting ends of said radiation portion.

6. An antenna as defined in claim 5, including distributed patch matching elements for providing capacitive coupling between said first and second tapered sections, whereby the capacitive coupling cancels the inductive part of the impedance looking into said matching element.

7. An antenna as defined in claim 6, said patch matching elements being located adjacent respective outer edges of said tapered sections.

8. An antenna as defined in claim 1, including a second loop element connected with said loop element to form a first center fed balanced 2-element antenna array, and including a feed structure having coplanar transmission lines extending from feeding points of said loop to an edge of said antenna, whereby said feed structure minimizes insertion loss of an RF signal applied thereto.

9. An antenna as defined in claim 1, said loop elements including a first and second pairs of said loop elements, said respective loop pairs being electrically parallel-connected to form first and second balanced sub-arrays; an approximately 0.65 wavelength coplanar transmission line connecting said first and second arrays; and a feed structure for coupling an end feed to said arrays.

10. An antenna as defined in claim 1, including a microstrip feed structure.

11. An antenna as defined in claim 10, said feed structure comprises an upper microstrip transmission line ground plane connected to a center point of said top load structure, and lower microstrip transmission line terminated at a central feed point of said radiation element through a via.

12. An antenna as defined in claim 1, including a bottom side-feed structure for providing wideband performance, said bottom side-feed including a ground plane and a multi impedance section.

13. An antenna as defined in claim 12, including a small patch connected to the ground plane for providing a capacitive coupling to cancel the inductive part of the impedance looking into the radiation portion.

14. An antenna as defined in claim 1, including first and second balanced 4-element sub-arrays; and a feed structure for coupling an center feed to said arrays, said feed comprising a half wavelength delay line for matching a 50 Ohm source impedance of a feed cable to the two 4-element antenna arrays and having the top and bottom 70.7 Ohm quarter wavelength microstrips impedance matching elements coupled from said delay line to respective arrays, whereby feed structure provides a transition from a coplanar to microstrip line through vias.

* * * * *